US012421971B1

(12) United States Patent
Ouyang et al.

(10) Patent No.: US 12,421,971 B1
(45) Date of Patent: Sep. 23, 2025

(54) WEARABLE COOLING FAN ASSEMBLY WITH ILLUMINATE DEVICE

(71) Applicants: Shenzhen Huijing Technology Co., Ltd., Shenzhen (CN); Guangzhou Colorful Stage Equipment Co., Ltd, Guangzhou (CN)

(72) Inventors: Zuhui Ouyang, Shenzhen (CN); Haiquan Pang, Shenzhen (CN)

(73) Assignees: Shenzhen Huijing Technology Co., Ltd., Shenzhen (CN); Guangzhou Colorful Stage Equipment Co., Ltd, Guangzhou (CN)

( * ) Notice: Subject to any disclaimer, the term of this patent is extended or adjusted under 35 U.S.C. 154(b) by 0 days.

(21) Appl. No.: 19/015,777

(22) Filed: Jan. 10, 2025

(51) Int. Cl.

| | |
|---|---|
| ***F04D 25/08*** | (2006.01) |
| ***A45F 5/02*** | (2006.01) |
| ***F04D 29/00*** | (2006.01) |
| ***F04D 29/42*** | (2006.01) |
| ***F04D 29/52*** | (2006.01) |

(52) U.S. Cl.
CPC ..... *F04D 25/08* (2013.01); *A45F 5/02* (2013.01); *F04D 29/005* (2013.01); *F04D 29/4226* (2013.01); *F04D 29/522* (2013.01)

(58) Field of Classification Search
None
See application file for complete search history.

(56) References Cited

PUBLICATIONS

KR-20190002293-U + machine translation (Year: 2019).*
Amazon.com—Fuliying Portable Waist Clip Fan (Accessed on May 6, 2025. Date First Available May 16, 2023. URL: https://www.amazon.com/fuliying-Portable-Handheld-Adjustable-Traveling/dp/B0C5CXZQ6J?th=1) (Year: 2023).*
Amazon.com—CAZOKASI 2024 Upgrade 10000mAh Waist Clip Fan (Accessed on May 6, 2025. Date First Available Feb. 29, 2024. URL: see attached document (Year: 2024).*

* cited by examiner

*Primary Examiner* — Juan G Flores

(57) ABSTRACT

A wearable cooling fan assembly with an illumination device is provided, which includes a housing, a fan, an illumination device, and at least one elastic clamping member. The housing defines a receiving space, has a first end surface, an opposite second end surface and a tubular side wall extending between the first and second end surfaces. The first end surface has an air outlet, and the housing has an air inlet, with both the air inlet and the air outlet in communication with the receiving space. The fan is mounted within the housing. The illumination device is mounted within the housing and configured to emit light outwardly from the housing. The at least one elastic clamping member is mounted on an outer periphery of the side wall of the housing and configured to clamp onto clothing of a user.

19 Claims, 11 Drawing Sheets

A - A

WEARABLE COOLING FAN ASSEMBLY WITH ILLUMINATE DEVICE

TECHNICAL FIELD

The present invention relates to the technical field of household electrical appliances, and in particular, to a wearable cooling fan assembly with an illumination device.

DESCRIPTION OF THE PRIOR ART

With the development of society, people's demand for comfort has been increasing, particularly for heat dissipation in hot conditions. However, traditional heat dissipation devices are typically large and require separate space for storage. Moreover, traditional fans are not convenient to use because they cannot be moved freely to meet the heat dissipation needs of users during sports or outdoor activities. Besides, people may need additional lighting in certain situations (such as at night or in low-light environments), which traditional heat dissipation devices cannot provide.

SUMMARY OF THE DISCLOSURE

In view of the above, the present invention provides a wearable cooling fan assembly with an illumination device, which can not only free users' hands but also provide a lighting function, meeting users' multiple needs, and offering improved portability and functionality.

In order to achieve the above objective, the present invention provides a wearable cooling fan assembly with an illumination device, which includes a housing, a fan, an illumination device, and at least one elastic clamping member. The housing defines a receiving space therein, which has a first end surface, an opposite second end surface and a tubular side wall extending between the first and second end surfaces. The first end surface has an air outlet, and the housing has an air inlet, with both the air inlet and the air outlet in communication with the receiving space. The fan is mounted within the housing. The illumination device is mounted within the housing and configured to emit light outwardly from the housing. The at least one elastic clamping member is mounted on an outer periphery of the side wall of the housing, and configured to clamp onto the clothing of a user.

Compared with the prior art, the wearable cooling fan assembly with an illumination device according to the embodiments of the present invention is a multifunctional device that provides heat dissipation, lighting and portability. The device can be fixed to the user's clothing or personal belongings with the elastic clamping member, ensuring it remains secure and does not fall off during exercise or work, while freeing the hands and significantly improving portability. Furthermore, the built-in fan can provide heat dissipation function through efficient air circulation, offering the user a cool and comfortable experience in high-temperature conditions. In addition, the illumination device can provide clear lighting in low light or night environments to meet lighting needs.

BRIEF DESCRIPTION OF DRAWINGS

In order to more clearly illustrate the technical solutions of the embodiments of the present invention, the following provides a brief description of the drawings accompanying the embodiments. It should be noted that the drawings presented only show some embodiments of the present invention. Based on these drawings, those skilled in the art can obtain other drawings without any creative effort.

DESCRIPTION OF EMBODIMENTS

Figure 1:
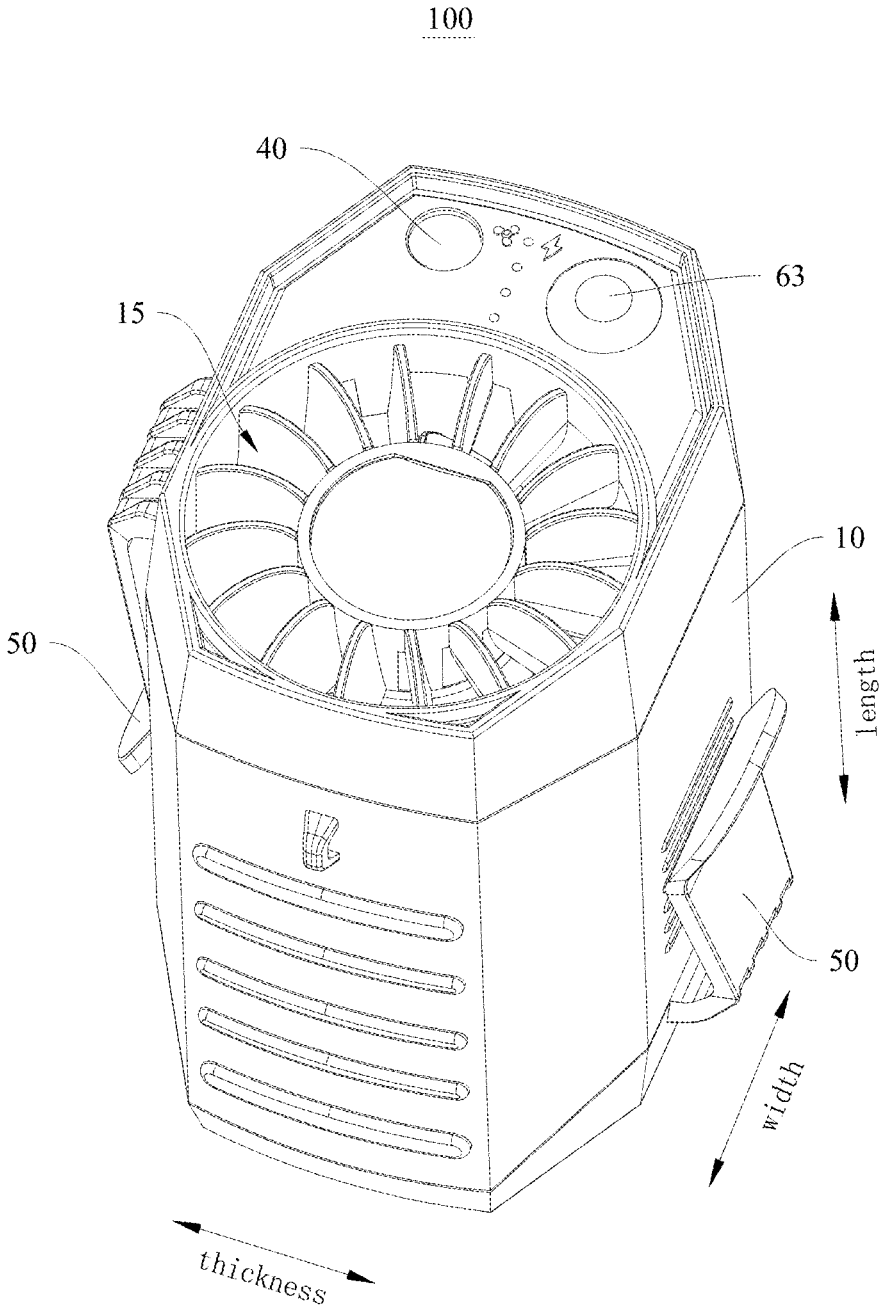
FIG. 1 is a schematic structural view of a wearable cooling fan assembly with an illumination device according to an embodiment of the present invention.

For a better understanding of the present invention, embodiment(s) of the present invention will be described more comprehensively below with reference to the accompanied drawings. One or more embodiments of the present invention are illustrated in the drawings for a clearer understanding of the technical solutions. However, it should be noted that the present invention can be embodied in different forms and is not limited to the embodiment(s) described below.

The same or similar reference numbers in the drawings of the present invention correspond to the same or similar elements. It should be noted that the directional terms such as 'upper', 'lower', 'left', and 'right' used in the description of the present invention are based on the orientation or positional relationship shown in the drawings, solely for the convenience of description and simplification, and do not indicate or imply that the device or element must have a specific orientation or be constructed or operated in a specific orientation. Therefore, the terms describing the positional relationship in the drawings are only used for illustrative purposes and should not be construed as limitations of the present invention. Those skilled in the art can understand the specific meanings of these terms according to specific circumstances.

Moreover, the terms such as 'first', 'second', etc., used in the embodiments of the present invention are solely for descriptive purposes and should not be construed as indicating or implying relative importance or the number of the technical features referred to. Therefore, the features defined by 'first' and 'second' may refer to at least one of such features. Furthermore, the expression 'and/or' as used in this description encompasses three possibilities. Taking 'A and/or B' as an example, it includes A alone, B alone, or both A and B together.

Furthermore, the technical solutions of different embodiments may be combined, as long as the combined technical solution is feasible for those skilled in the art. If the technical solutions to be combined are contradictory or cannot be implemented, such a combination should be considered non-existent and outside the protection scope of the present invention.

Referring to FIGS. 1 to 4, an embodiment of the present invention provides a wearable cooling fan assembly 100 with an illumination device, including a housing 10, a fan 30, an illumination device 40 and at least one elastic clamping member 50.

The housing 10 defines a receiving space 11, and has a first axial end surface 12, an opposite second axial end surface 13, and a tubular side wall 14 extending between the first and second axial end surfaces 12, 13. In other words, the housing 10 is generally shaped as a hollow column. Both the fan 30 and the illumination device 40 are installed inside the housing 10.

The illumination device 40 can emit light outward from the housing 10, so as to provide lighting for the user in poor light conditions, for example, during outdoor activities such as running, hiking, or cycling.

An air outlet 15 is provided on the first axial end surface 12. The second axial end surface 13 and/or the tubular side wall 14 is provided with at least one air inlet 16. Both the at least one air inlet 16 and the air outlet 15 are in communication with the receiving space 11. The at least one air inlet 16 can include one, two, or more air inlets. The at least one air inlet 16 can be located solely on the second axial end surface 13, solely on the tubular side wall 14, or on both the second axial end surface 13 and the tubular side wall 14. When the fan 30 works, the external air is sucked into the receiving space 11 from the at least one air inlet 16, and discharged from the air outlet 15, achieving ventilation and heat dissipation.

At least one elastic clamping member 50 is mounted on the outer periphery of the tubular side wall 14, and the at least one elastic clamping member 50 is used to clamp onto the user's clothing.

The wearable cooling fan assembly 100 with the illumination device 40 according to this embodiment of the present invention is a multifunctional device that provides heat dissipation, lighting and portability. The device can be fixed to the user's clothing or personal belongings with the elastic clamping member 50, ensuring it remains secure and does not fall off during exercise or work, while freeing the hands and significantly improving portability. Furthermore, the built-in fan 30 can provide heat dissipation function through efficient air circulation, offering the user a cool and comfortable experience in high-temperature conditions. In addition, the illumination device 40 can provide clear lighting in low light or night environments to meet lighting needs.

In one embodiment, the housing 10 is made of a hard material such as polypropylene (PP), polyvinyl chloride (PVC), polycarbonate (PC) or the like, to support the components inside.

The number of the at least one elastic clamping member 50 is not particularly limited, and may be one, two, or more. For example, in one embodiment, referring to FIGS. 8 and 9, the at least one elastic clamping member 50 includes one elastic clamping member 50 disposed on one lateral side of the tubular side wall 14. In another embodiment, referring to FIGS. 1 and 2, the at least one elastic clamping member 50 includes two elastic clamping members 50 disposed on opposite lateral sides of the tubular side wall 14, respectively.

Figure 2:
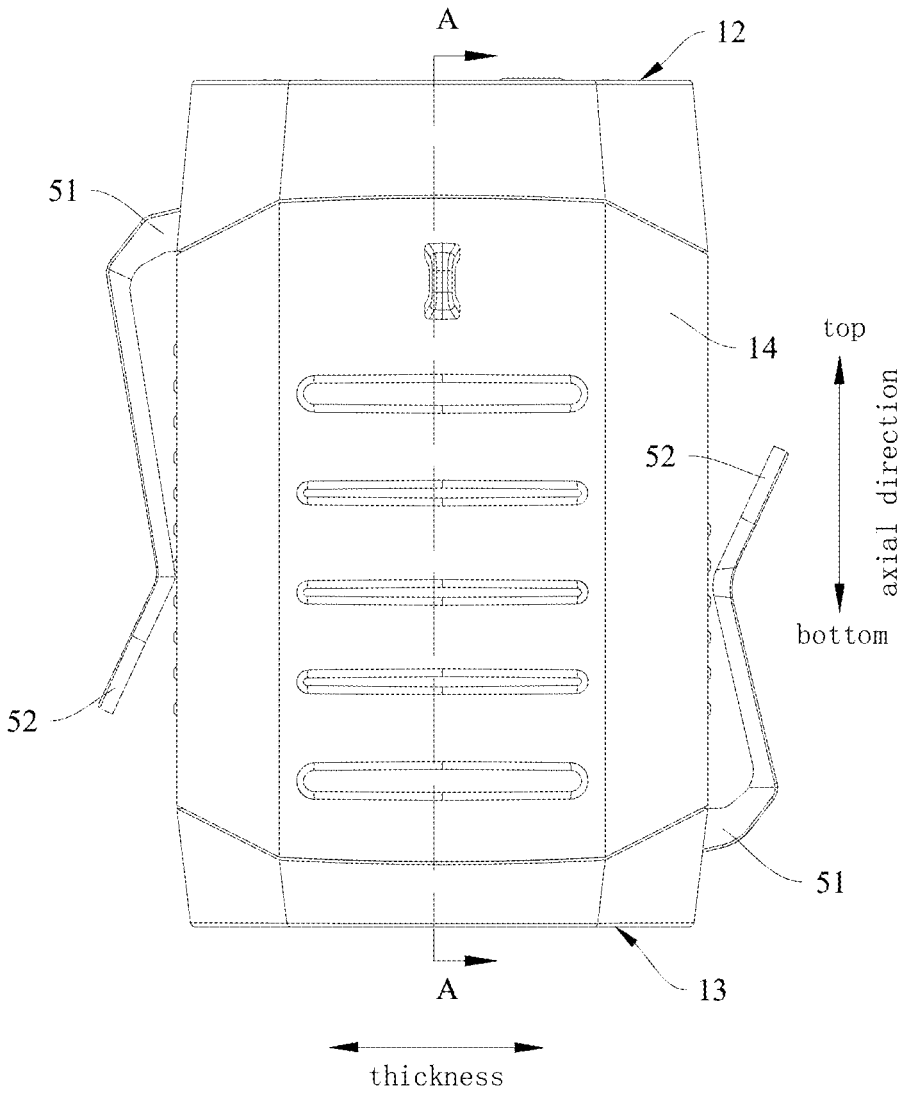
FIG. 2 is another view of the wearable cooling fan assembly shown in FIG. 1.

In one embodiment, referring to FIG. 2, each elastic clamping member 50 extends in the axial direction of the housing 10, and the axial direction of the housing 10 extends through the first axial end surface 12 and the second axial end surface 13. Each elastic clamping member 50 includes a first end 51 connected to the tubular side wall 14 and a second free end 52. The free ends 52 of the two elastic clamping members 50 are oriented oppositely. For better understanding, referring to FIG. 2, the axial direction of the housing 10 is parallel to the up-down direction shown in this drawing. The free end 52 of one elastic clamping member 50 (the left elastic clamping member) extends downward, while the free end 52 of the other elastic clamping member 50 (the right elastic clamping member) extends upward. The user can use any of the elastic clamping members 50 to attach to clothing or personal belongings in different situations, providing various wearing options and enhanced portability.

Figure 8:
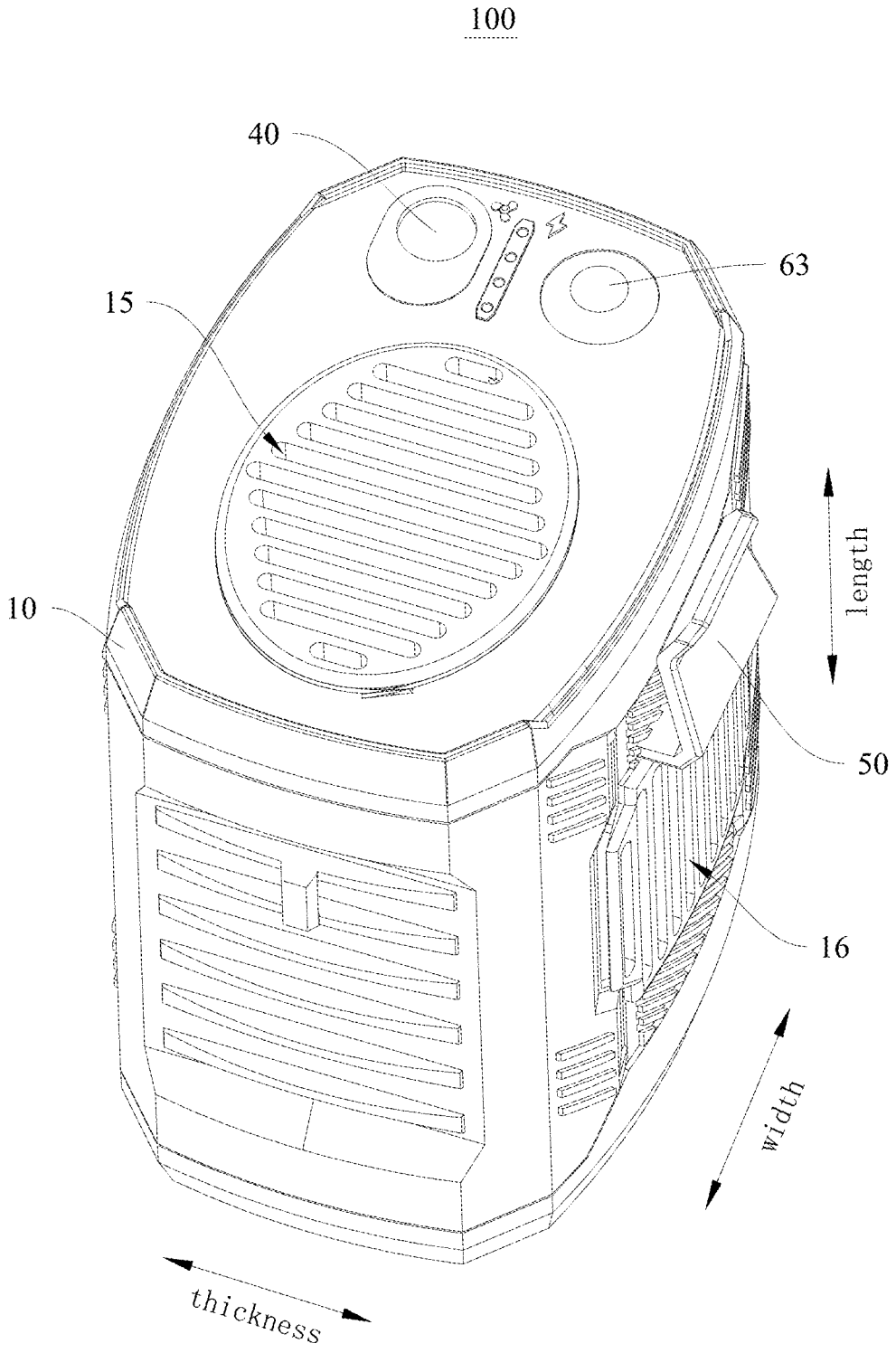
FIG. 8 is a schematic structural view of a wearable cooling fan assembly with an illumination device according to another embodiment of the present invention.
Figure 9:
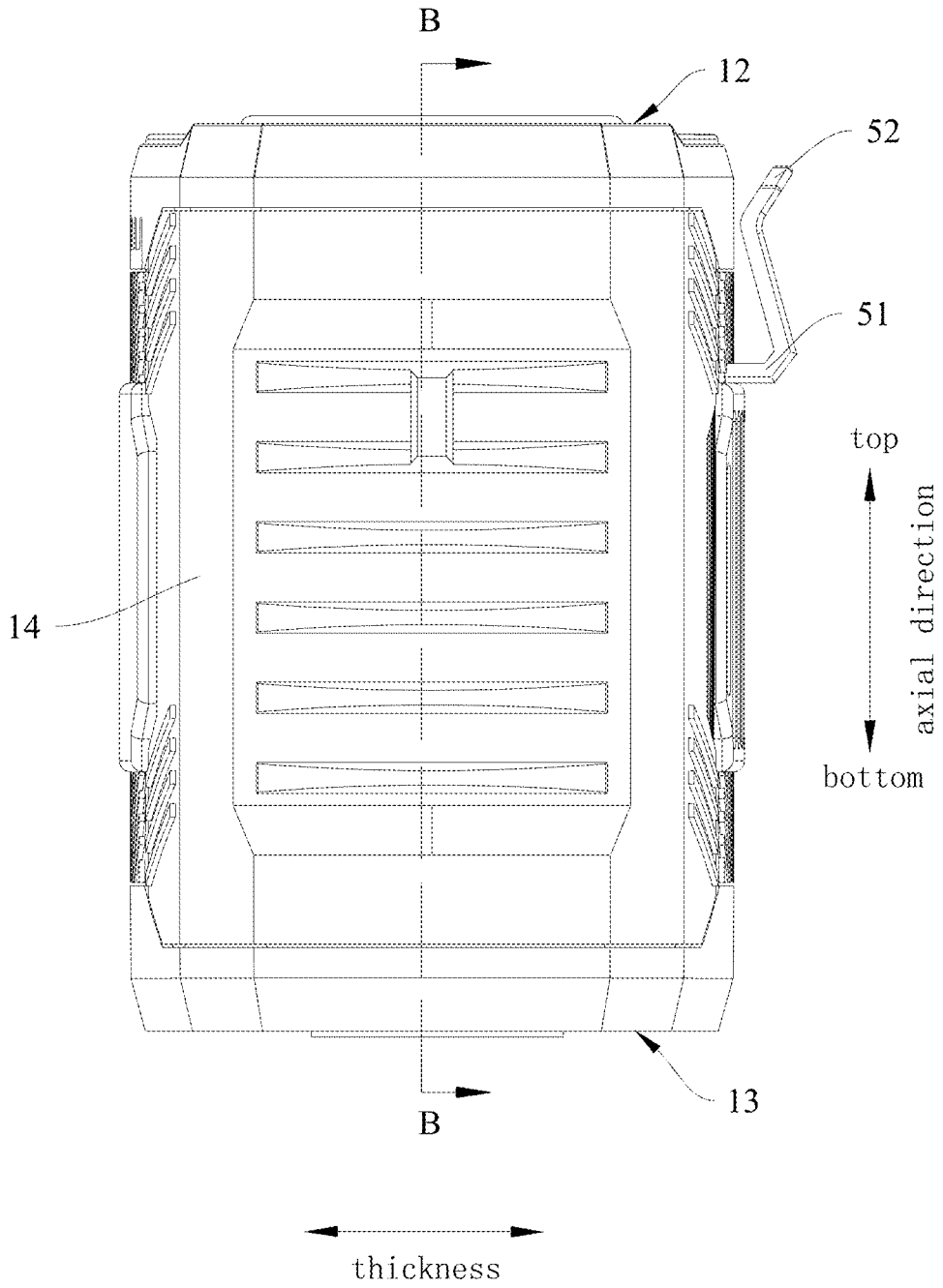
FIG. 9 is another view of the wearable cooling fan assembly shown in FIG. 8.

In one embodiment, referring to FIG. 1 and FIG. 8, the housing 10 has a polygonal cross-section. For example, the housing 10 can be generally shaped as a column, and the cross-section of the column may be a polygonal cross-section. In one embodiment, referring to FIG. 1 and FIG. 8, the housing 10 has a length measured along the axial direction and a width measured along a first transverse direction perpendicular to the axial direction, and the length of the housing 10 is greater than the width of the housing 10. In other words, the length of the housing 10 in the axial direction is greater than the width of the housing 10 in a certain transverse direction. Further, in one embodiment, referring to FIG. 1 and FIG. 8, the housing 10 has a thickness measured along a second transverse direction perpendicular to the axial direction and the first transverse direction, and the thickness is less than the width of the housing 10. In other words, the housing 10 has a generally cuboid structure, the length of the housing 10 is greater than the width, and the width is greater than the thickness.

In one embodiment, each elastic clamping member 50 extends in the axial direction of the housing 10, and the length of each elastic clamping member 50 extending in the axial direction is at least ⅓ of the length of the housing 10. In one embodiment, referring to FIGS. 1 and 2, the length of the elastic clamping member 50 extending in the axial direction is at least ½ of the length of the housing 10. The greater the axial length of the elastic clamping member 50, the larger the contact area between the elastic clamping member 50 and the user's clothing and belongings, and the greater the reliability and firmness of the clamping.

Figure 3:
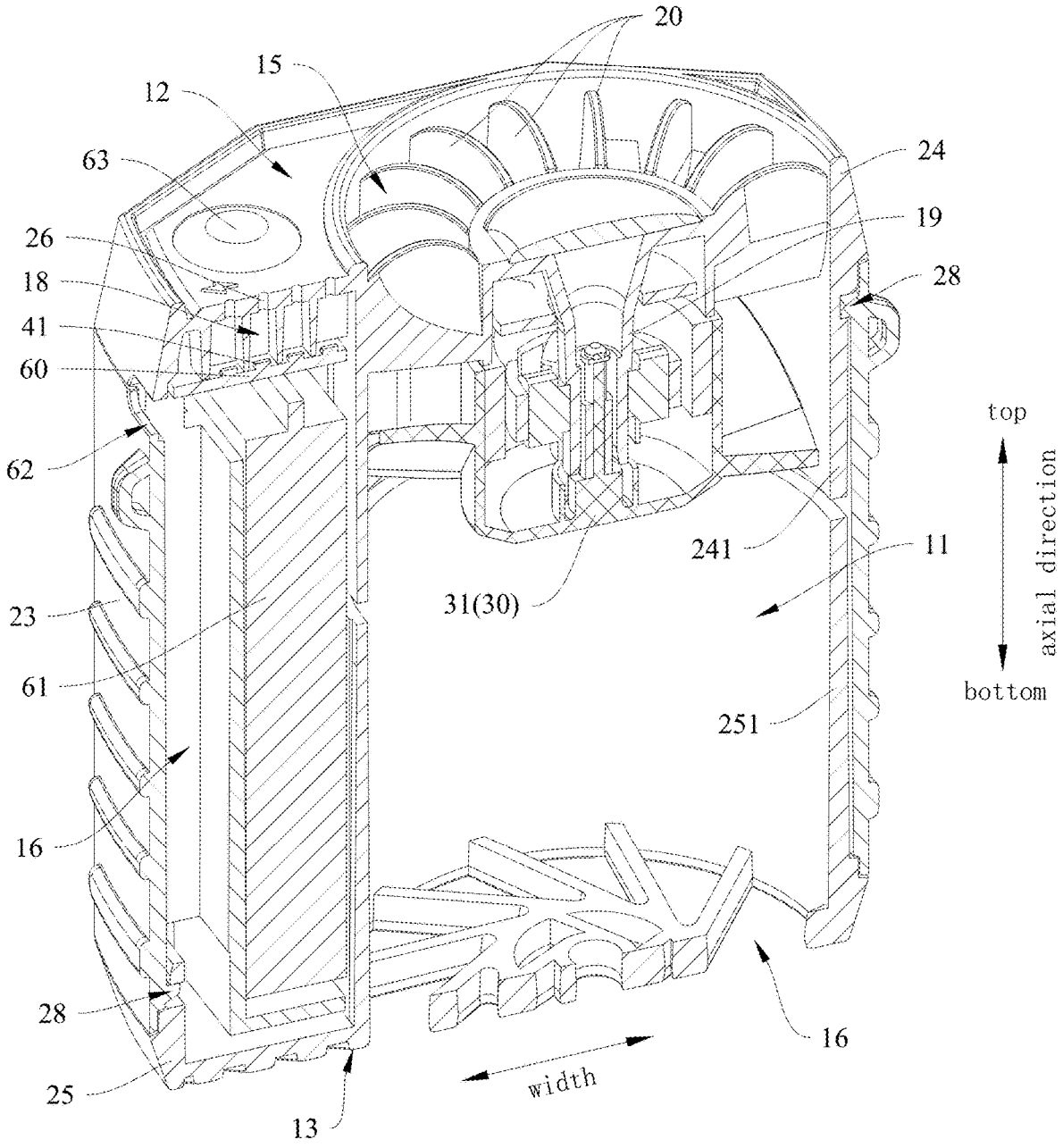
FIG. 3 is a cross-sectional view of the wearable cooling fan assembly shown in FIG. 2 along line A-A.
Figure 4:
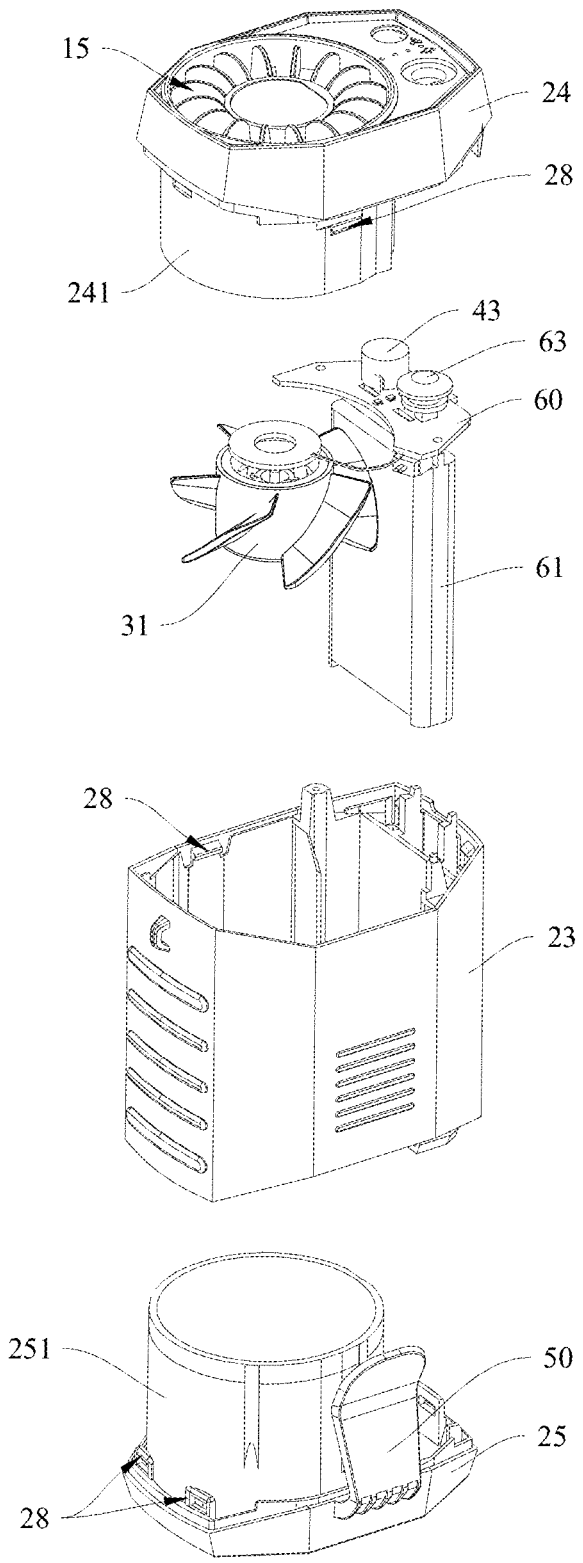
FIG. 4 is an exploded view of the wearable cooling fan assembly shown in FIG. 1.
Figure 5:
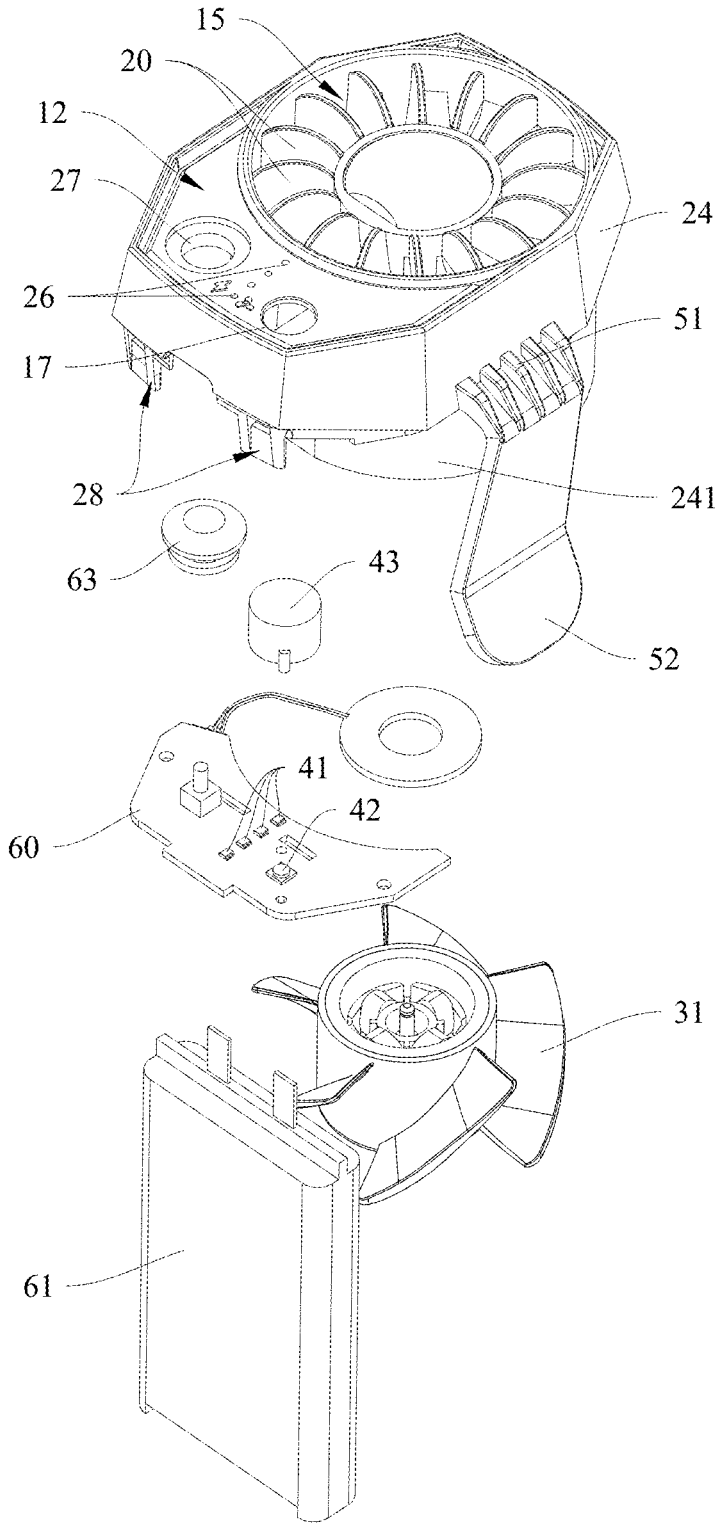
FIG. 5 is another exploded view of the wearable cooling fan assembly shown in FIG. 1, which schematically shows the illumination device, the top cover, and the fan among others.

In one embodiment, referring to FIGS. 3 to 5, the illumination device 40 includes at least one LED, a PCB 60 on which a control module is installed and a battery 61. The control module is connected to the fan 30 and the battery 61, powered by the battery 61 to control the fan 30's actions, such as turning on/off and adjusting speed.

In one embodiment, the housing 10 defines a mounting chamber 16 isolated from the receiving space 11, and the illumination device 40 is mounted in the mounting chamber 16. Referring to FIG. 3, the fan 30 is placed in the receiving space 11, and multiple electrical components such as the LED, the PCB 60, and the battery 61 are all disposed in the mounting chamber 16, so that the airflow from the rotating fan 30 does not disturb the multiple electrical components located in the mounting chamber 16, which improves the working stability and service life of the device.

In one embodiment, referring to FIGS. 3 to 5, the at least one LED of the illumination device 40 includes at least one indicator LED 41 connected to the control module to control the on/off state of the at least one indicator LED 41. The at least one indicator LED 41 can indicate signals by emitting light, flashing or gradually changing, to display the working status of the device, such as the on/off state of the power supply, the speed mode of the fan 30, etc. The number of the at least one indicator LED 41 can vary based on needs, which may be one, two or more.

The housing 10 may have at least one light-transmitting hole 26 that communicates with the interior of the housing 10, positioned at suitable locations as needed. Alternatively, part of the housing material may be thinned to create at least one light-transmitting area for light to pass through. The at least one indicator LED 41 is positioned to correspond with the at least one light-transmitting hole 26 or at least one light-transmitting area, so that the light emitted by the at least one indicator LED 41 can pass outward through the at least one light-transmitting hole 26 or at least one light-transmitting area. For example, in one embodiment, referring to FIGS. 3 to 5, the at least one indicator LED 41 is provided on the PCB 60. The PCB 60 is close to the first axial end face 12, and is arranged opposite and parallel to the first axial end face 12. The first axial end surface 12 defines at least one light-transmitting hole 26 corresponding in number to the at least one indicator LED 41, and each indicator LED 41 aligns with a corresponding light-transmitting hole 26 in the axial direction. In the case where there are multiple indicator LEDs 41, they may be arranged in a row at intervals along any straight line, or may be arranged in a circle at intervals. For example, referring to FIG. 3 to FIG. 5, four indicator LEDs 41 and four light-transmitting holes 26 are respectively arranged in a row along a straight line perpendicular to the axial direction, and are aligned one-to-one in the axial direction.

In other embodiments, the at least one indicator LED 41 can be placed at any position in the housing 10 as required. For example, the at least one indicator LED 41 can be placed near the tubular side wall 14 or near the second axial end surface 13. The housing 10 can define at least one light-transmitting hole 26 or at least one light-transmitting area corresponding to the at least one indicator LED 41, so that the light emitted by the at least one indicator LED 41 can pass outward through the at least one light-transmitting hole 26 or at least one light-transmitting area. The PCB 60 can be placed at any position in the housing 10 as required, and the at least one indicator LED 41 can be electrically connected to the control module on the PCB 60 through a wire.

In one embodiment, the housing 10 defines at least one light guide cavity 18, each containing an indicator LED 41. For example, referring to FIG. 3, the inner wall of the housing 10 has at least one inward-extending cylindrical protrusion, and each cylindrical protrusion defines a light guide cavity 18. Each light guide cavity 18 corresponds to a light-transmitting hole 26 and contains an indicator LED 41. The light guide cavity 18 can limit and secure the indicator LED 41 in place, preventing displacement from external impacts or bumps, and can focus the light emitted by the indicator LED 41.

Figure 6:
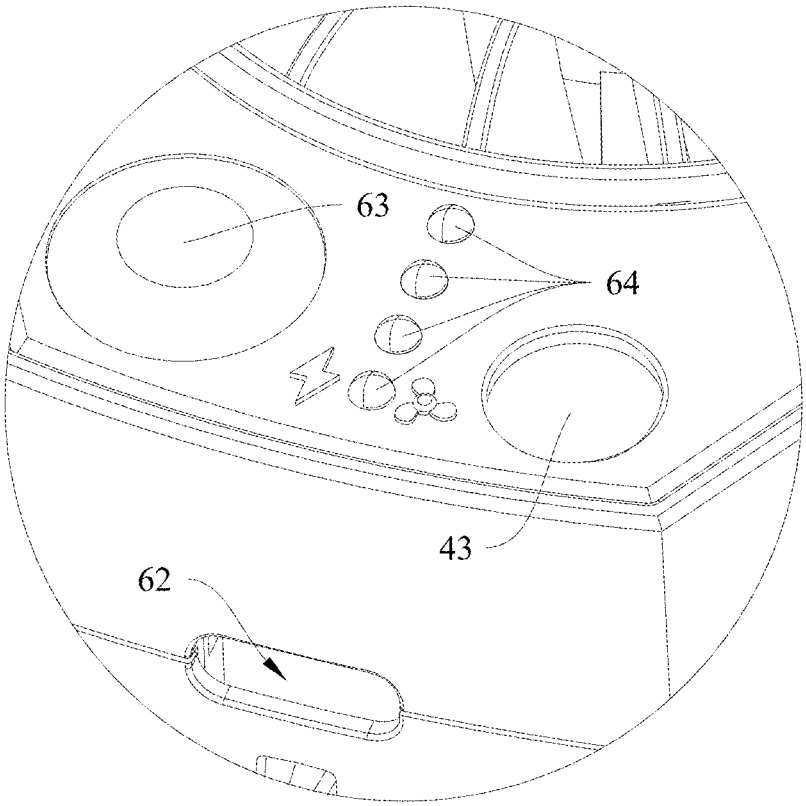
FIG. 6 is an enlarged view of the top cover of the wearable cooling fan assembly shown in FIG. 1, schematically illustrating the outer appearance of one type of light guide cover.
Figure 7:
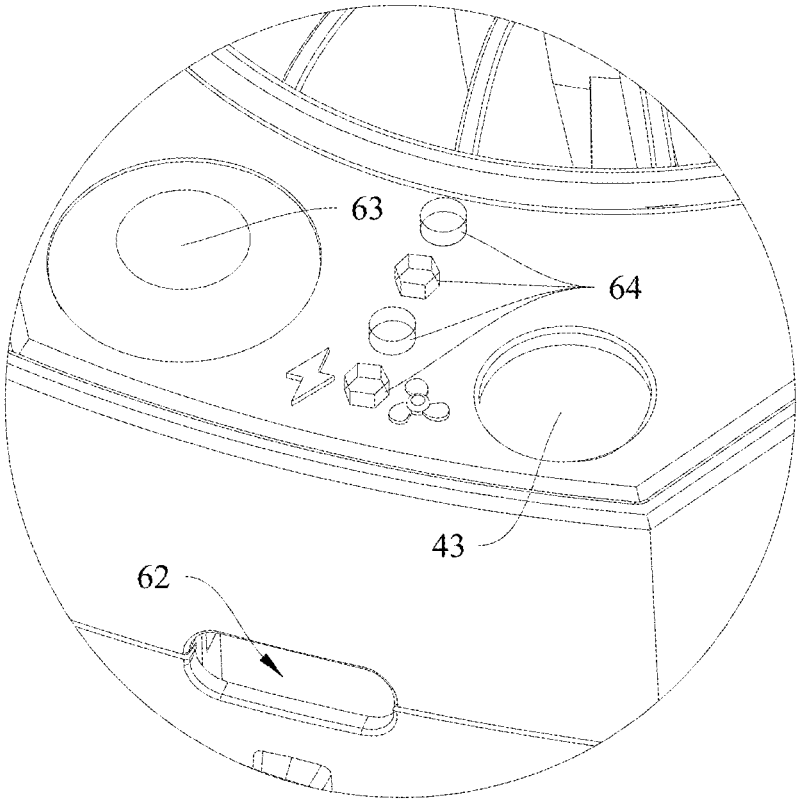
FIG. 7 is an enlarged view of an alternative top cover of the wearable cooling fan assembly shown in FIG. 1, schematically illustrating the outer appearances of two different types of light guide covers.

In other embodiments, referring to FIG. 6 and FIG. 7, the wearable cooling fan assembly 100 with the illumination device 40 further includes at least one light guide cover 64 corresponding to the at least one light-transmitting hole 26. Each light guide cover 64 corresponds to an indicator LED 41. The light guide cover 64 is light-transmissive. The light emitted by each indicator LED 41 can pass outward through a corresponding light guide cover 64. The contour shape of the light guide cover 64 may be, but is not limited to, a hemisphere, a cylinder, or a polygonal prism.

In one embodiment, referring to FIG. 3 and FIG. 6, the battery 61 is a rechargeable battery 61 fixedly disposed in the housing 10, and the wearable cooling fan assembly 100 further includes a charging interface 62 electrically connected to the battery 61 for charging the battery 61. In other embodiments, the battery 61 can be a removable battery 61 for user replacement.

The charging interface 62 may vary based on needs, which may be, but is not limited to, USB (Universal Serial Bus), Lightning Connector, DC Power Jack or Qi Wireless Charging Interface, etc. For example, in one embodiment, referring to FIG. 6, the charging interface 62 is a Universal Serial Bus Type-C interface.

In one embodiment, referring to FIGS. 3 to 5, the at least one LED of the illumination device 40 further includes a lighting LED 42 and a lens 43 covering the lighting LED 42. The lighting LED 42 is configured to emit light outward from the housing 10. The control module is connected to the lighting LED 42 and powered by the battery 61 to turn on and off the lighting LED 42. The lens 43 is positioned over the lighting LED 42 to scatter or focus the light emitted by the lighting LED 42, thus enhancing the lighting effect.

In one embodiment, referring to FIGS. 3 to 5, the housing 10 defines a mounting hole 17, and the lens 43 is sealingly mounted in the mounting hole 17 (i.e., the lens 43 is mounted in the mounting hole 17 in a sealed manner). The mounting hole 17 allows the lens 43 to be firmly connected to the housing 10, which is convenient for manufacturing and assembly.

Alternatively, the lighting LED 42 can be placed at any position near the inner wall of the housing 10 as required, and electrically connected to the control module on the PCB 60 through a wire or directly placed on the PCB 60. In one embodiment, referring to FIGS. 3 to 5, the PCB 60 is arranged parallel to the first axial end surface 12, and the lighting LED 42 is arranged on the PCB 60. The mounting hole 17 is defined on the first axial end surface 12, and the lens 43 is sealingly mounted in the mounting hole 17 and located between the mounting hole 17 and the lighting LED 42. The light emitted by the lighting LED 42 exits outward from the first axial end surface 12 after being scattered or focused by the lens 43.

In one embodiment, referring to FIGS. 3 to 5, the wearable cooling fan assembly 100 with the illumination device 40 further includes a switch button 63 mounted on the first axial end surface 12 of the housing 10. The switch button 63 is electrically connected to the control module. The user can control the fan 30 and lighting LED 42, including their on/off states and working modes, through the switch button 63. In other embodiments, the switch button 63 can be installed at other locations on the housing 10 as needed, for example, on the tubular side wall 14 or on the second axial end surface 13.

The structure of the fan 30 is not particularly limited. In one embodiment, referring to FIGS. 3 to 5, the fan 30 is an axial-flow fan 31 mounted on a mounting base 19. The at least one air inlet 16 consists of one air inlet, which is defined on the second axial end surface 13. The air inlet 16 located on the second axial end surface 13 and the air outlet 15 located on the first axial end surface 12 are opposite to each other in the axial direction. The mounting base 19 is provided on the housing 10 and located in the middle of the air outlet 15. The housing 10 is further provided with a plurality of first air guide ribs 20 connecting the outer periphery of the mounting base 19 and the inner wall surrounding the air outlet 15. The plurality of first air guide ribs 20 are evenly spaced from each other in the circumferential direction of the housing 10, which allows the airflow generated by the axial-flow fan 31 to be evenly discharged from the air outlet 15, avoiding wind or vibration noise caused by uneven airflow distribution. Since the airflow direction generated by the axial-flow fan 31 is parallel to the axial direction, the air inlet 16 is defined on the second axial end surface 13. This allows the air to flow smoothly in a straight line, avoiding eddy currents and turbulence, ensuring efficient air circulation and ventilation.

Figure 10:
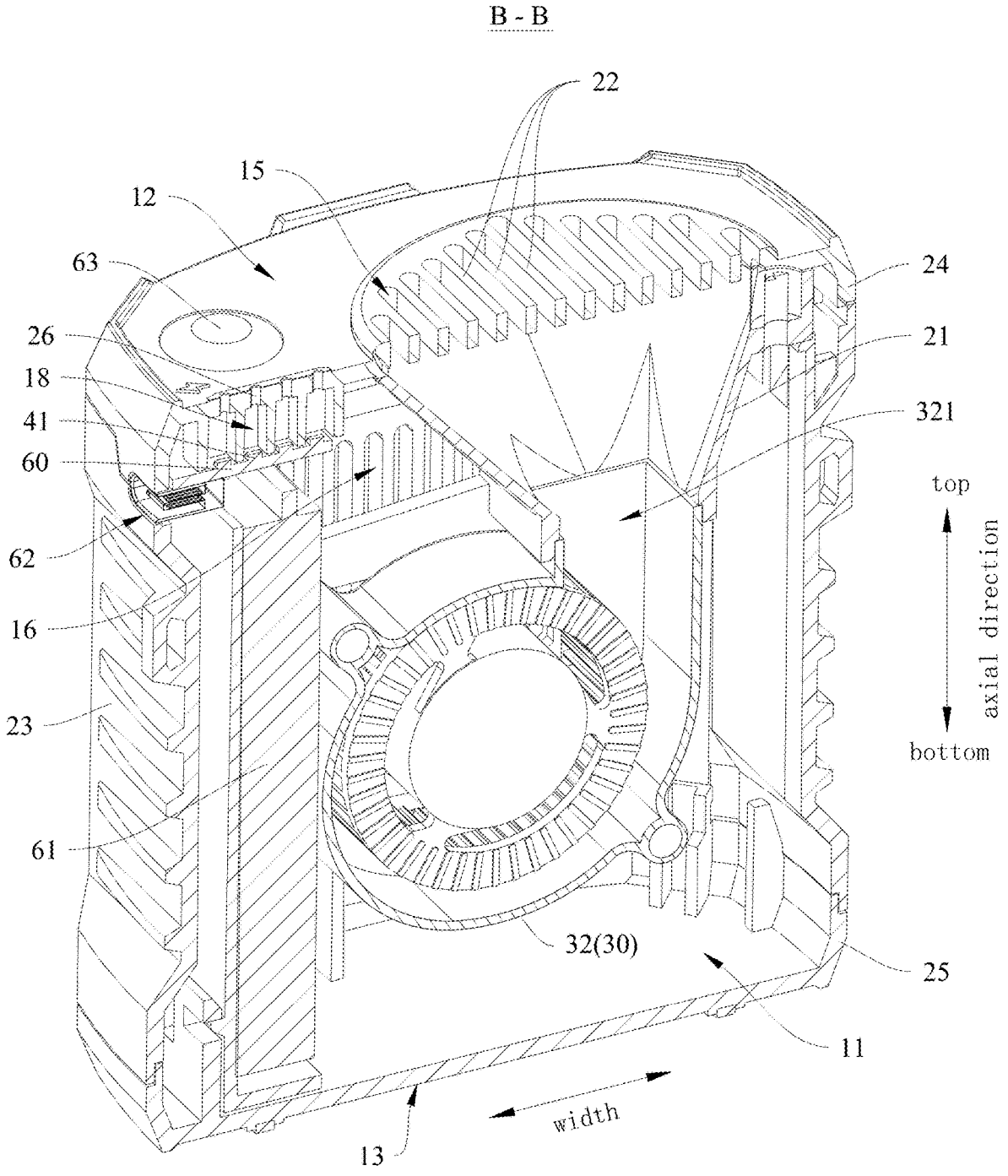
FIG. 10 is a cross-sectional view of the wearable cooling fan assembly shown in FIG. 9 along line B-B.
Figure 11:
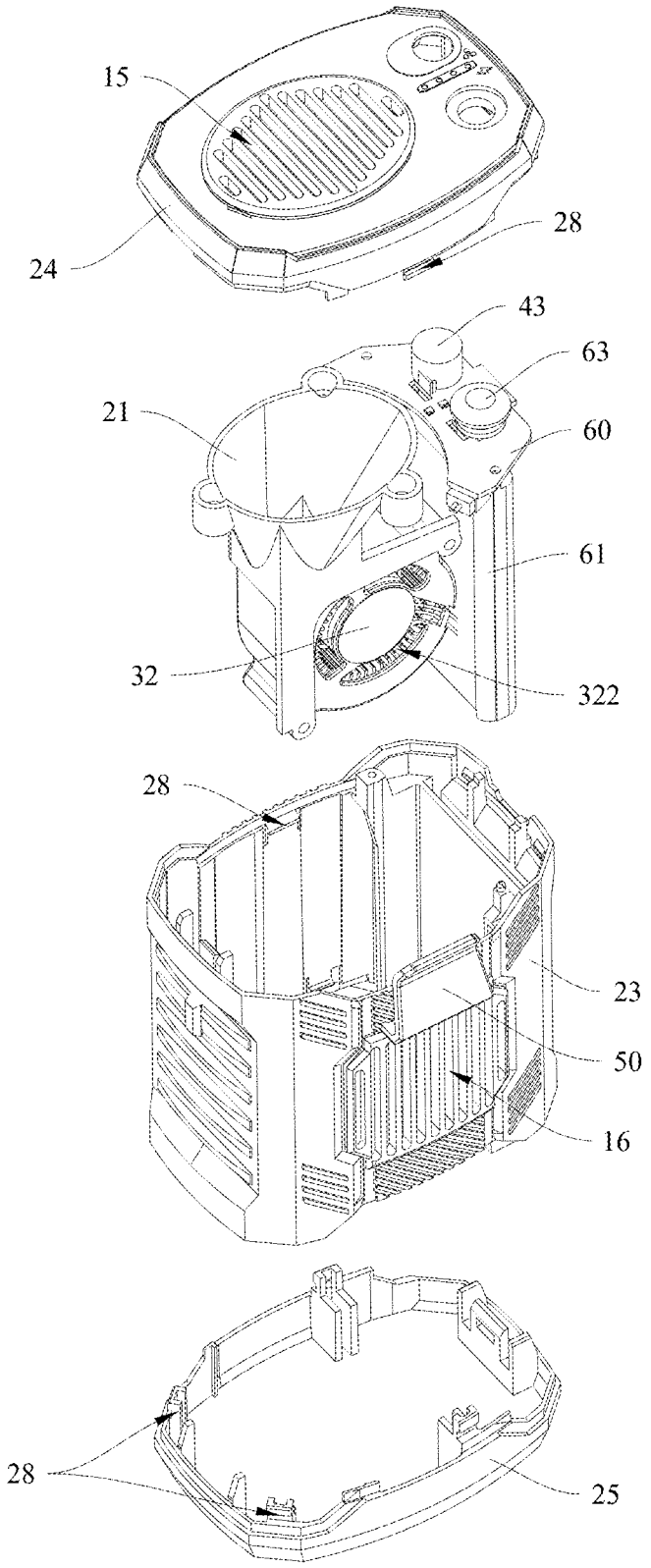
FIG. 11 is an exploded view of the wearable cooling fan assembly shown in FIG. 8.

In another embodiment, referring to FIG. 10 and FIG. 11, the fan 30 is a centrifugal fan 32 installed in the receiving space 11. The housing 10 is provided with a guide box 21 with openings at both axial ends and a plurality of second air guide ribs 22. The plurality of second air guide ribs 22 are arranged in the air outlet 15 in parallel and spaced apart. The two axial ends of the guide box 21 are respectively connected to an air exhaust port 321 of the centrifugal fan 32 and the air outlet 15. The at least one air inlet 16 consists of one air inlet, which is defined on the tubular side wall 14. The air inlet 16 on the tubular side wall 14 is opposite to an air intake port 322 of the centrifugal fan 32. The centrifugal fan 32 has a compact structure and a higher space efficiency. The guide box 21 is a hollow structure with openings at both axial ends, and its cross-sectional area gradually increases from the air exhaust port 321 to the air outlet 15 to guide the airflow, reducing wind noise and vibration, and preventing airflow disturbance from the rotating centrifugal fan 32 from affecting the illumination device 40.

In one embodiment, referring to FIGS. 1, 3, 8 and 10, the housing 10 includes a hollow sleeve 23 with two axial ends opened, a top cover 24 connected to the upper end of the hollow sleeve 23 and a bottom cover 25 connected to the lower end of the hollow sleeve 23. The air outlet 15 is defined on the top cover 24. As an example, both the light-transmitting holes 26 and the mounting hole 17 are defined on the top cover 24. The top cover 24 defines a button hole 27, and the switch button 63 is sealingly mounted in the button hole 27 (i.e., the switch button 63 is mounted in the button hole 27 in a sealed manner). The light-transmitting holes 26, the mounting hole 17 and the switch button 63 are all located on one side of the air outlet 15 in the width direction of the housing 10, and the light-transmitting holes 26 are spaced at intervals in the width direction of the housing 10. In the thickness direction of the housing 10, the light-transmitting holes 26 are located between the mounting hole 17 and the switch button 63. In one embodiment, referring to FIGS. 3 and 4, the fan 30 is the axial-flow fan 31 installed on the mounting base 19, and the air inlet 16 is defined on the bottom cover 25. In another embodiment, referring to FIGS. 10 and 11, the fan 30 is the centrifugal fan 32 installed in the receiving space 11, and the air inlet 16 is defined on one side of the hollow sleeve 23 in the thickness direction of the housing 10.

The top cover 24 can be connected to the hollow sleeve 23 by threaded connection, bonding, riveting, or expansion connection among others. In one embodiment, the top cover 24 is connected to the hollow sleeve 23 through snap(s) 28. For example, referring to FIGS. 4 and 11, the outer edge of the top cover 24 is detachably connected to the inner peripheral wall of the hollow sleeve 23 through a plurality of snaps 28.

The bottom cover 25 can be connected to the hollow sleeve 23 by threaded connection, bonding, riveting, expansion connection among others. In one embodiment, the bottom cover 25 is connected to the hollow sleeve 23 through snap(s) 28. For example, referring to FIGS. 4 and 11, the outer edge of the bottom cover 25 is detachably connected to the inner peripheral wall of the hollow sleeve 23 through a plurality of snaps 28.

In one embodiment, referring to FIG. 3 and FIG. 4, an air inlet 16 is defined on the bottom cover 25. The top cover 24 has a first cylinder 241, and the bottom cover 25 has a second cylinder 251. The first cylinder 241 and the second cylinder 251 extend toward each other, and the inner space of the first cylinder 241 and the inner space of the second cylinder 251 together define the receiving space 11. The fan 30 is received in the first cylinder 241. The hollow sleeve 23 surrounds the first cylinder 241 and the second cylinder 251 to form the mounting chamber 16, in which the illumination device 40 is installed. As an example, the extension directions of the first cylinder 241 and the second cylinder 251 are both in the axial direction of the housing 10. For better understanding, referring to FIG. 3, the axial direction of the housing 10 is parallel to the up-down direction shown in this drawing. The upper end of the first cylinder 241 is the air outlet 15 in which the mounting base 19 is provided. The fan 30 is an axial-flow fan 31 installed on the mounting base 19. The lower end of the first cylinder 241 is arranged opposite to the upper end of the second cylinder 251. The lower end of the second cylinder 251 is the air inlet 16. The mounting chamber 16 is located on one side of the receiving space 11 in the width direction of the housing 10, and the battery 61 and the PCB 60 of the illumination device 40 are respectively arranged in the mounting chamber 16. The PCB 60 is arranged close to the top cover 24, and the battery 61 is arranged on the lower side of the PCB 60. The at least one indicator LED 41, lighting LED 42, lens 43 and switch button 63 are arranged on the upper side of the PCB 60. The upper end of the lens 43 is sealingly connected to the mounting hole 17 of the top cover 24, and the lower end of the lens 43 covers the lighting LED 42. The upper end of the switch button 63 is sealingly connected to the button hole 27, and the lower end of the switch button 63 is electrically connected to the PCB 60.

In one embodiment, the at least one elastic clamping member 50 includes two elastic clamping members 50, and the two elastic clamping members 50 are respectively connected to the outer edges of the top cover 24 and the bottom cover 25. As an example, in one embodiment, referring to FIG. 2, the two elastic clamping members 50 are respectively arranged on opposite sides of the housing 10 in the thickness direction. The elastic clamping member 50 on the top cover 24 includes a first end 51 connected to the top cover 24 and a second free end 52 extending toward the bottom cover 25. The elastic clamping member 50 on the bottom cover 25 includes a first end 51 connected to the bottom cover 25 and a second free end 52 extending toward the top cover 24.

In one embodiment, referring to FIG. 10 and FIG. 11, the top cover 24, the bottom cover 25 and the hollow sleeve 23 connected between the top cover 24 and the bottom cover 25 together enclose a receiving space 11. The fan 30 is a centrifugal fan 32 disposed in the receiving space 11. The air outlet 15 is defined on the top cover 24. The air inlet 16 is defined on one side of the hollow sleeve 23 in the thickness direction of the housing 10 and is opposite to the air intake port 322 of the centrifugal fan 32. The air exhaust port 321 of the centrifugal fan 32 is in communication with the air outlet 15 through the guide box 21. The illumination device 40 is located in the receiving space 11 and is located on one side of the centrifugal fan 32 in the width direction of the housing 10. The PCB 60 is arranged close to the top cover 24, and the battery 61 is arranged on the lower side of the PCB 60. The at least one indicator LED 41, lighting LED 42, lens 43 and switch button 63 are arranged on the upper side of the PCB 60. The upper end of the lens 43 is sealingly connected to the mounting hole 17 of the top cover 24, and the lower end of the lens 43 covers the lighting LED 42. The upper end of the switch button 63 is sealingly connected to the button hole 27, and the lower end of the switch button 63 is electrically connected to the PCB 60.

In one embodiment, the at least one elastic clamping member 50 includes one elastic clamping member 50 connected to the hollow sleeve 23. As an example, referring to FIG. 9, the elastic clamping member 50 includes a first end 51 connected to one side of the hollow sleeve 23 in the thickness direction of the housing 10 and a second free end 52 extending toward the top cover 24.

Finally, it should be noted that the above descriptions pertain only to the preferred embodiments of the present invention and should not be construed as limiting the protection scope of the present invention. While the present invention has been detailed with reference to the aforementioned embodiments, it will be apparent to those skilled in the art that modifications can be made to the technical solutions described, or some technical features can be equivalently replaced. Any modifications, equivalent replacements, or improvements made within the spirit and principles of the present invention should fall within its scope of protection.

The invention claimed is:

1. A wearable cooling fan assembly with an illumination device, comprising:

a housing defining a receiving space, the housing having a first end surface, an opposite second end surface and a tubular side wall extending between the first and second end surfaces, the first end surface having an air outlet, and the housing having an air inlet, with the air inlet and outlet in communication with the receiving space;

a fan disposed within the housing;

the illumination device disposed within the housing and configured to emit light outwardly from the housing; and at least one elastic clamping member arranged on an outer periphery of the side wall of the housing and configured to clamp onto a user's clothing;

wherein the housing comprises a hollow sleeve with openings at two axial ends, a top cover connected to an upper end of the hollow sleeve and a bottom cover connected to a bottom end of the hollow sleeve, and wherein the air inlet is defined in at least one of the hollow sleeve and the bottom cover, and the air outlet is defined in the top cover.

2. The wearable cooling fan assembly with an illumination device of claim 1, wherein the at least one elastic clamping member comprises two elastic clamping members respectively arranged on opposite lateral sides of the side wall of the housing.

3. The wearable cooling fan assembly with an illumination device of claim 2, wherein each elastic clamping member extends in an axial direction of the housing extending through the first and second end surfaces, and comprises a first end connected to the side wall of the housing and a second free end, and wherein the free ends of the two elastic clamping members are oriented oppositely.

4. The wearable cooling fan assembly with an illumination device of claim 1, wherein the illumination device comprises:

at least one LED;

a PCB; and a battery, wherein the PCB is connected to the at least one LED and the battery and is configured to be powered by the battery to control ON and OFF of the at least one LED.

5. The wearable cooling fan assembly with an illumination device of claim 4, wherein the at least one LED comprises at least one indicator LED, and the housing defines at least one light guide cavity corresponding to the at least one indicator LED.

6. The wearable cooling fan assembly with an illumination device of claim 4, wherein the at least one LED comprises a lighting LED, and the illumination device further comprises a lens covering the lighting LED.

7. The wearable cooling fan assembly with an illumination device of claim 6, wherein the housing defines a mounting hole, and the lens is mounted in the mounting hole in a sealed manner.

8. The wearable cooling fan assembly with an illumination device of claim 4, wherein the battery is rechargeable, and the wearable cooling fan assembly comprises a charging interface electrically connected to the battery for charging the battery.

9. The wearable cooling fan assembly with an illumination device of claim 4, wherein the housing defines a mounting chamber isolated from the receiving space, and the illumination device is received in the mounting chamber.

10. The wearable cooling fan assembly with an illumination device of claim 1, wherein the housing comprises a mounting base at a central portion of the air outlet, and a plurality of first air guide ribs connecting an outer periphery of the mounting base with an inner wall surrounding the air outlet, the fan is an axial-flow fan mounted at the mounting base; and wherein the first air guide ribs are evenly arranged in a circumferential direction of the housing.

11. The wearable cooling fan assembly with an illumination device of claim 1, wherein the air inlet is defined in the bottom cover; the top cover comprises a first cylinder, the bottom cover comprises a second cylinder, and the first and second cylinders extend toward each other and together define the receiving space, wherein the fan is received within the first cylinder; and the hollow sleeve surrounds the first and second cylinders to form a mounting chamber for receiving the illumination device.

12. The wearable cooling fan assembly with an illumination device of claim 1, wherein the at least one elastic clamping member comprises two elastic clamping members connected to outer peripheries of the top cover and the bottom cover respectively.

13. The wearable cooling fan assembly with an illumination device of claim 12, wherein the elastic clamping member on the top cover comprises a first end connected to the top cover and a second free end extending towards the bottom cover, and the elastic clamping member on the bottom cover comprises a first end connected to the bottom cover and a second free end extending towards the top cover.

14. The wearable cooling fan assembly with an illumination device of claim 1, wherein the housing has a length measured in an axial direction and a width measured in a first transverse direction perpendicular to the axial direction, and wherein the length of the housing is greater than the width of the housing.

15. The wearable cooling fan assembly with an illumination device of claim 14, wherein the housing has a thickness measured in a second transverse direction perpendicular to the axial direction and the first transverse direction, and the thickness is less than the width of the housing.

16. The wearable cooling fan assembly with an illumination device of claim 14, wherein each elastic clamping member extends in the axial direction of the housing, and a length of each elastic clamping member in the axial direction is at least ⅓ of the length of the housing.

17. The wearable cooling fan assembly with an illumination device of claim 16, wherein the length of each elastic clamping member in the axial direction is at least ½ of the length of the housing.

18. The wearable cooling fan assembly with an illumination device of claim 1, wherein the housing has a polygon cross section.

19. The wearable cooling fan assembly with an illumination device of claim 1, wherein the top cover comprises a first cylinder, the bottom cover comprises a second cylinder, and the first and second cylinders extend toward each other and together define the receiving space, wherein the fan is received within the first cylinder; and wherein hollow sleeve comprises a mounting wall extending radially inwardly and defines a mounting chamber located at a radial outer side of the receiving space and isolated from the receiving space, the illumination device is mounted in the mounting chamber and supported by the mounting wall.

* * * * *